US007518134B2

(12) United States Patent
Ivanov et al.

(10) Patent No.: US 7,518,134 B2
(45) Date of Patent: Apr. 14, 2009

(54) PLASMA RADIATION SOURCE FOR A LITHOGRAPHIC APPARATUS

(75) Inventors: Vladimir Vitalevitch Ivanov, Moscow (RU); Vadim Yevgenyevich Banine, Helmond (NL); Konstantin Nikolaevitch Koshelev, Troitsk (RU); Vladimir Mihailovitch Krivtsun, Troitsk (RU)

(73) Assignee: ASML Netherlands B.V., Veldhoven (NL)

( * ) Notice: Subject to any disclaimer, the term of this patent is extended or adjusted under 35 U.S.C. 154(b) by 231 days.

(21) Appl. No.: 11/634,386

(22) Filed: Dec. 6, 2006

(65) Prior Publication Data

US 2008/0137050 A1 Jun. 12, 2008

(51) Int. Cl.
*H05G 2/00* (2006.01)

(52) U.S. Cl. ..... 250/504 R; 250/492.1; 250/493.1; 313/232; 313/163; 313/172; 313/171; 313/165; 378/119; 378/134; 378/135; 378/136

(58) Field of Classification Search ..... 250/492.1, 250/493.1, 504 R; 313/232, 163, 172, 171, 313/165, 326; 378/119, 134, 135, 136
See application file for complete search history.

(56) References Cited

U.S. PATENT DOCUMENTS

2005/0264775 A1 * 12/2005 Kurt et al. ..... 355/43
2007/0085044 A1 * 4/2007 Hergenhan et al. ..... 250/504 R

FOREIGN PATENT DOCUMENTS

WO 2005/025280 A2 3/2005
WO WO 2005/025280 * 3/2005
WO WO 2005101924 A1 * 10/2005

* cited by examiner

*Primary Examiner*—Jack I Berman
*Assistant Examiner*—Michael Maskell
(74) *Attorney, Agent, or Firm*—Pillsbury Winthrop Shaw Pittman LLP

(57) ABSTRACT

A radiation source is disclosed that includes an anode and a cathode that are configured and arranged to create a discharge in a substance in a discharge space between the anode and the cathode and to form a plasma so as to generate electromagnetic radiation, the anode and the cathode being rotatably mounted around an axis of rotation, the cathode being arranged to hold a liquid metal. The radiation source further includes an activation source arranged to direct an energy beam onto the liquid metal so as to vaporize part of the liquid metal and a liquid metal provider arranged to supply additional liquid metal so as to compensate for the vaporized part of the liquid metal.

21 Claims, 3 Drawing Sheets

PLASMA RADIATION SOURCE FOR A LITHOGRAPHIC APPARATUS

FIELD

The present invention relates to a lithographic apparatus and a plasma radiation source for a lithographic apparatus.

BACKGROUND

A lithographic apparatus is a machine that applies a desired pattern onto a substrate, usually onto a target portion of the substrate. A lithographic apparatus can be used, for example, in the manufacture of integrated circuits (ICs). In that instance, a patterning device, which is alternatively referred to as a mask or a reticle, may be used to generate a circuit pattern to be formed on an individual layer of the IC. This pattern can be transferred onto a target portion (e.g. comprising part of, one, or several dies) on a substrate (e.g. a silicon wafer). Transfer of the pattern is typically via imaging onto a layer of radiation-sensitive material (resist) provided on the substrate. In general, a single substrate will contain a network of adjacent target portions that are successively patterned. Known lithographic apparatus include so-called steppers, in which each target portion is irradiated by exposing an entire pattern onto the target portion at one time, and so-called scanners, in which each target portion is irradiated by scanning the pattern through a radiation beam in a given direction (the "scanning"-direction) while synchronously scanning the substrate parallel or anti-parallel to this direction. It is also possible to transfer the pattern from the patterning device to the substrate by imprinting the pattern onto the substrate.

In order to decrease the critical dimension of devices, a lithographic projection apparatus may be arranged with a radiation source for EUV radiation. The EUV radiation source may be, for example, a discharge plasma radiation source, in which a plasma is generated in a substance (for instance, a gas or vapor) between an anode and a cathode and in which a high temperature discharge plasma may be created by ohmic heating caused by a (pulsed) current flowing through the plasma.

SUMMARY

An EUV radiation source may have a rotating electrode wherein a cathode is partly covered with a liquid layer (e.g., tin) used as a consumable working substance together with a disc shaped anode inside the cathode. A laser beam is directed to the tin layer to create vaporized tin which triggers the discharge. The tin layer on the cathode will slowly degenerate due to the vaporization. Consumption of tin cannot be automatically restored.

Accordingly, it is desirable, for example, to provide a plasma radiation source as described above wherein the consumption of the consumable working substance may be restored.

According to an aspect of the invention, there is provided a radiation source, comprising:

an anode and a cathode that are configured and arranged to create a discharge in a substance in a discharge space between the anode and the cathode and to form a plasma so as to generate electromagnetic radiation, the anode and the cathode being rotatably mounted around an axis of rotation, the cathode being arranged to hold a liquid metal;

an activation source arranged to direct an energy beam onto the liquid metal so as to vaporize part of the liquid metal in order to create a substance for the discharge; and a liquid metal provider arranged to supply additional liquid metal so as to compensate for the vaporized part of the liquid metal.

According to a further aspect of the invention, there is provided a lithographic apparatus, comprising:

a radiation source, comprising:

an anode and a cathode that are configured and arranged to create a discharge in a substance in a discharge space between the anode and the cathode and to form a plasma so as to generate electromagnetic radiation, the anode and the cathode being rotatably mounted around an axis of rotation, the cathode being arranged to hold a liquid metal, an activation source arranged to direct an energy beam onto the liquid metal so as to vaporize part of the liquid metal in order to create a substance for the discharge, and a liquid metal provider arranged to supply additional liquid metal so as to compensate for the vaporized part of the liquid metal;

an illumination system configured to condition a radiation beam;

a support constructed to support a patterning device, the patterning device configured to impart the radiation beam with a pattern in its cross-section to form a patterned radiation beam;

a substrate table constructed to hold a substrate; and a projection system configured to project the patterned radiation beam onto a target portion of the substrate.

According to a further aspect of the invention, there is provided a method of producing radiation comprising:

creating a discharge voltage across an anode and a cathode, the anode mounted inside the cathode and the cathode holding a liquid metal;

rotating the anode and the cathode;

directing an energy beam onto the liquid metal so as to vaporize part of the liquid metal creating a discharge in the vapor in a discharge space between the anode and the cathode so as to form a plasma and generate electromagnetic radiation; and supplying additional liquid metal to the liquid metal so as to compensate for the vaporized part of the liquid metal.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
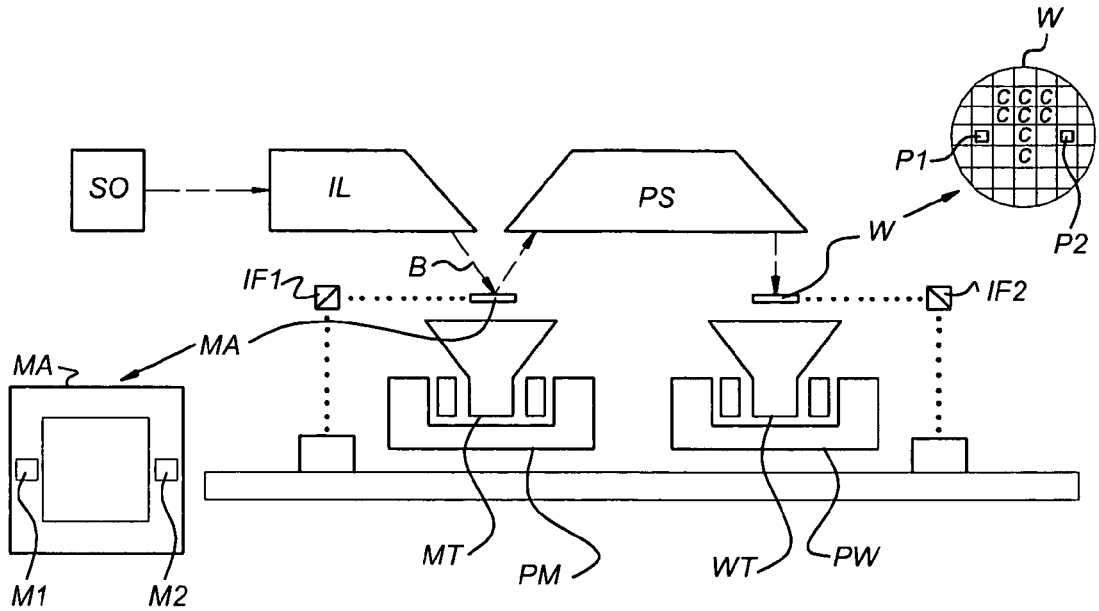
FIG. 1 depicts a lithographic apparatus according to an embodiment of the invention.

FIG. 1 schematically depicts a lithographic apparatus according to one embodiment of the invention. The apparatus comprises:

an illumination system (illuminator) IL configured to condition a radiation beam B (e.g. UV radiation or EUV radiation);

a support structure (e.g. a mask table) MT constructed to support a patterning device (e.g. a mask) MA and connected to a first positioner PM configured to accurately position the patterning device in accordance with certain parameters;

a substrate table (e.g. a wafer table) WT constructed to hold a substrate (e.g. a resist-coated wafer) W and connected to a second positioner PW configured to accurately position the substrate in accordance with certain parameters; and a projection system (e.g. a refractive projection lens system) PS configured to project a pattern imparted to the radiation beam B by patterning device MA onto a target portion C (e.g. comprising one or more dies) of the substrate W.

The illumination system may include various types of optical components, such as refractive, reflective, magnetic, electromagnetic, electrostatic or other types of optical components, or any combination thereof, for directing, shaping, or controlling radiation.

The support structure holds the patterning device in a manner that depends on the orientation of the patterning device, the design of the lithographic apparatus, and other conditions, such as for example whether or not the patterning device is held in a vacuum environment. The support structure can use mechanical, vacuum, electrostatic or other clamping techniques to hold the patterning device. The support structure may be a frame or a table, for example, which may be fixed or movable as required. The support structure may ensure that the patterning device is at a desired position, for example with respect to the projection system. Any use of the terms "reticle" or "mask" herein may be considered synonymous with the more general term "patterning device."

The term "patterning device" used herein should be broadly interpreted as referring to any device that can be used to impart a radiation beam with a pattern in its cross-section such as to create a pattern in a target portion of the substrate. It should be noted that the pattern imparted to the radiation beam may not exactly correspond to the desired pattern in the target portion of the substrate, for example if the pattern includes phase-shifting features or so called assist features. Generally, the pattern imparted to the radiation beam will correspond to a particular functional layer in a device being created in the target portion, such as an integrated circuit.

The patterning device may be transmissive or reflective. Examples of patterning devices include masks, programmable mirror arrays, and programmable LCD panels. Masks are well known in lithography, and include mask types such as binary, alternating phase-shift, and attenuated phase-shift, as well as various hybrid mask types. An example of a programmable mirror array employs a matrix arrangement of small mirrors, each of which can be individually tilted so as to reflect an incoming radiation beam in different directions. The tilted mirrors impart a pattern in a radiation beam which is reflected by the mirror matrix.

The term "projection system" used herein should be broadly interpreted as encompassing any type of projection system, including refractive, reflective, catadioptric, magnetic, electromagnetic and electrostatic optical systems, or any combination thereof, as appropriate for the exposure radiation being used, or for other factors such as the use of an immersion liquid or the use of a vacuum. Any use of the term "projection lens" herein may be considered as synonymous with the more general term "projection system".

As here depicted, the apparatus is of a reflective type (e.g. employing a reflective mask). Alternatively, the apparatus may be of a transmissive type (e.g. employing a transmissive mask).

The lithographic apparatus may be of a type having two (dual stage) or more substrate tables (and/or two or more support structures). In such "multiple stage" machines the additional tables and/or support structures may be used in parallel, or preparatory steps may be carried out on one or more tables and/or support structures while one or more other tables and/or support structures are being used for exposure.

The lithographic apparatus may also be of a type wherein at least a portion of the substrate may be covered by a liquid having a relatively high refractive index, e.g. water, so as to fill a space between the projection system and the substrate. An immersion liquid may also be applied to other spaces in the lithographic apparatus, for example, between the mask and the projection system. Immersion techniques are well known in the art for increasing the numerical aperture of projection systems. The term "immersion" as used herein does not mean that a structure, such as a substrate, must be submerged in liquid, but rather only means that liquid is located between the projection system and the substrate during exposure.

Referring to FIG. 1, the illuminator IL receives a radiation beam from a plasma radiation source SO. The plasma radiation source SO and the lithographic apparatus may be separate entities. In such cases, the source is not considered to form part of the lithographic apparatus and the radiation beam is passed from the plasma radiation source SO to the illuminator IL with the aid of a beam delivery system comprising, for example, suitable directing mirrors and/or a beam expander. The plasma radiation source SO and the illuminator IL, together with the beam delivery system if required, may be referred to as a 'radiation system'.

The illuminator IL may comprise an adjuster for adjusting the angular intensity distribution of the radiation beam. Generally, at least the outer and/or inner radial extent (commonly referred to as σ-outer and σ-inner, respectively) of the intensity distribution in a pupil plane of the illuminator can be adjusted. In addition, the illuminator IL may comprise various other components, such as an integrator and a condenser. The illuminator may be used to condition the radiation beam, to have a desired uniformity and intensity distribution in its cross-section.

The radiation beam B is incident on the patterning device (e.g., mask) MA, which is held on the support structure (e.g., mask table) MT, and is patterned by the patterning device. Having traversed the patterning device MA, the radiation beam B passes through the projection system PS, which focuses the beam onto a target portion C of the substrate W. With the aid of the second positioner PW and position sensor IF2 (e.g. an interferometric device, linear encoder or capacitive sensor), the substrate table WT can be moved accurately, e.g. so as to position different target portions C in the path of the radiation beam B. Similarly, the first positioner PM and another position sensor IF1 can be used to accurately position the patterning device MA with respect to the path of the radiation beam B, e.g. after mechanical retrieval from a mask library, or during a scan. In general, movement of the support structure MT may be realized with the aid of a long-stroke module (coarse positioning) and a short-stroke module (fine positioning), which form part of the first positioner PM. Similarly, movement of the substrate table WT may be realized using a long-stroke module and a short-stroke module, which form part of the second positioner PW. In the case of a stepper (as opposed to a scanner) the support structure MT may be connected to a short-stroke actuator only, or may be fixed. Patterning device MA and substrate W may be aligned using patterning device alignment marks M1, M2 and substrate alignment marks P1, P2. Although the substrate alignment marks as illustrated occupy dedicated target portions, they may be located in spaces between target portions (these are known as scribe-lane alignment marks). Similarly, in situations in which more than one die is provided on the patterning device MA, the patterning device alignment marks may be located between the dies.

The depicted apparatus could be used in at least one of the following modes:

1. In step mode, the support structure MT and the substrate table WT are kept essentially stationary, while an entire pattern imparted to the radiation beam is projected onto a target portion C at one time (i.e. a single static exposure). The substrate table WT is then shifted in the X and/or Y direction so that a different target portion C can be exposed. In step mode, the maximum size of the exposure field limits the size of the target portion C imaged in a single static exposure.

2. In scan mode, the support structure MT and the substrate table WT are scanned synchronously while a pattern imparted to the radiation beam is projected onto a target portion C (i.e. a single dynamic exposure). The velocity and direction of the substrate table WT relative to the support structure MT may be determined by the (de-)magnification and image reversal characteristics of the projection system PS. In scan mode, the maximum size of the exposure field limits the width (in the non-scanning direction) of the target portion in a single dynamic exposure, whereas the length of the scanning motion determines the height (in the scanning direction) of the target portion.

3. In another mode, the support structure MT is kept essentially stationary holding a programmable patterning device, and the substrate table WT is moved or scanned while a pattern imparted to the radiation beam is projected onto a target portion C. In this mode, generally a pulsed radiation source is employed and the programmable patterning device is updated as required after each movement of the substrate table WT or in between successive radiation pulses during a scan. This mode of operation can be readily applied to maskless lithography that utilizes programmable patterning device, such as a programmable mirror array of a type as referred to above.

Combinations and/or variations on the above described modes of use or entirely different modes of use may also be employed.

The radiation source SO according to an embodiment, comprises an anode and a cathode that are configured and arranged to create a discharge in a substance in a discharge space between the anode and the cathode. A plasma will be formed which will generate electromagnetic radiation. The anode and the cathode are rotatably mounted around an axis of rotation.

Figure 2:
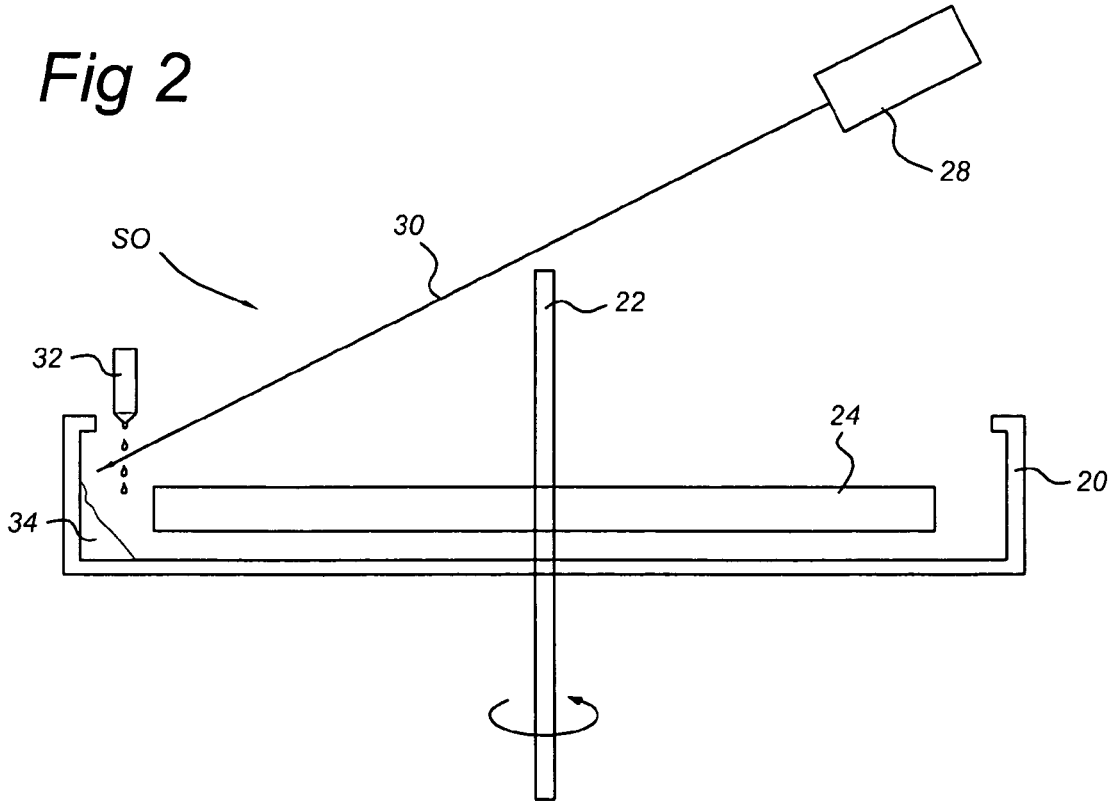
FIG. 2 shows a plasma radiation source SO according to an embodiment of the invention.

FIG. 2 shows a plasma radiation source SO according to an embodiment of the invention. The plasma radiation source SO comprises a hollow disc shaped cathode 20 rotatably mounted around a rod 22. The plasma radiation source SO further comprises a disc shaped anode 24 inside the hollow cathode 20. The anode 24 is also mounted to the rod 22 so as to rotate together with the cathode 20. The plasma radiation source SO also comprises or is connected to an energy beam source 28, such as a laser beam source 28, which directs an energy beam 30 to an inner surface of the cathode 20. A liquid metal provider 32 is positioned so as to produce droplets of liquid metal, e.g. Sn, to a liquid metal bath 34 inside the hollow cathode 20. By providing the droplets to the bath 34, the consumption of the liquid metal is restored. By providing a suitable amount of liquid metal, the amount of liquid metal in the cathode 20 remains substantially stable under action of a discharge. The dripping of liquid metal into the fast rotating cathode 20 may lead to a rippling on the surface of the liquid metal layer/bath 34.

Figure 3:
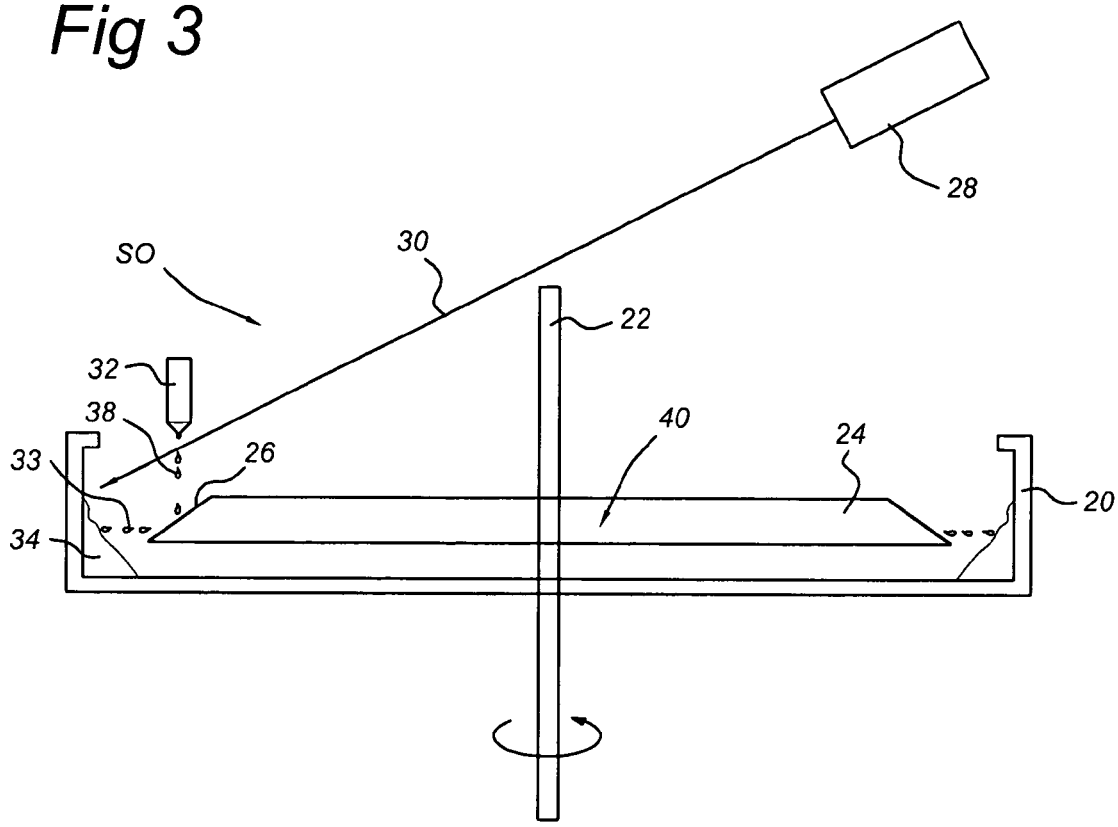
FIG. 3 shows a plasma radiation source SO according to a further embodiment of the invention.

FIG. 3 shows a plasma radiation source SO according to a further embodiment of the invention. The disc shaped anode 24 has a rim 26 which is inclined with respect to a plane in which the anode 24 is lying. The liquid metal provider 32 is positioned just above the anode 24 so as to provide droplets of liquid metal, e.g. Sn, to the inclined rim 26 of the rotating anode 24. By dropping liquid droplets onto the rim 26, the active surface of the anode, i.e. the rim 26, is wetted and protected against erosion caused by a discharge of the vapor liquid that is present between the anode 24 and the cathode 20. Due to the rotating movement of anode 24, an excess of the liquid metal present on the rim 26 is swept from the rim 26 to the inner surface of the cathode 20 to produce a liquid metal layer and/or a liquid metal bath. The liquid metal 33 leaving the anode rim 26, hits the inner surface of the cathode 20, or the bath 34, in the form of very small droplets with a velocity that is very close to cathode velocity. This will reduce the rippling effect as compared to the embodiment of FIG. 2 and thereby possibly increase EUV radiation yield stability.

Furthermore, by also wetting the anode surface, the anode surface remains more stable under action of the discharge, decreasing the effect of erosion and thus increasing the lifetime of the total radiation source.

If a radius R of anode 24 is for example R=20 cm and the gap between anode 24 and cathode 20 is ΔR=0.2 cm, the resulting relative velocity of droplets which come from the anode 24 to the cathode 20 can be described as follows:

$$v_\Phi = 2v_0(\Delta R/R) = 0.01v_0 \quad (1)$$

$$v_r = v_0(2\Delta R/R)^{1/2} = 0.14v_0 \quad (2)$$

where $v_\Phi$ is a component tangential to the surface, $v_r$ is a component perpendicular to the surface, and $v_0$ is the linear velocity of the rim 26 of the rotating anode 24.

Figure 4:
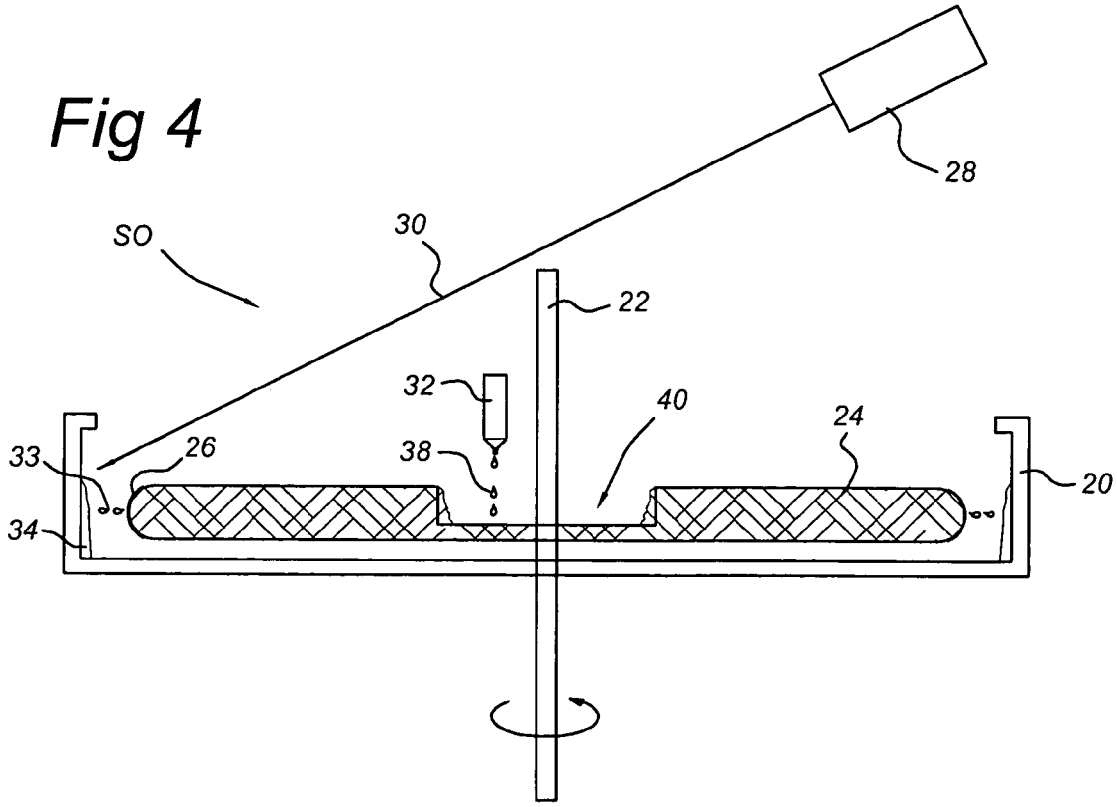
FIG. 4 shows a plasma radiation source SO according to a further embodiment of the invention.

In a further embodiment, referring to FIG. 4, droplets of liquid metal 38 are supplied in a hollow part 40 of the anode 24 of the plasma radiation source SO. The anode 24 comprises a porous body through which the liquid metal will penetrate to the working anode surface, i.e. the rim 26, wetting it and thus protecting it by evaporation of the liquid metal under discharge action. Again, an excess of the liquid metal is swept from anode surface 26 to the cathode bath 34 or the cathode 20 in the form of very small droplets 33 with a velocity that is very close to cathode velocity, which helps to minimize the rippling effect.

The liquid metal moves through the porous anode body due to centrifugal forces, which correspond to a centrifugal acceleration in a range of defined by:

$$\alpha = v_0^2/R = 10^3 \text{ to } 10^4 \text{ m/s}^2 \quad (3)$$

On the exit at the anode rim 26, the liquid metal already has proper azimuthal velocity close to that of the cathode 20. A large centrifugal force results in the formation of droplets with a characteristic radius r of:

$$r = (3\sigma/a\rho)^{1/2} \quad (4)$$

and a volume V of:

$$V = 2\cdot 3^{1/2}\pi(\sigma/a\rho)^{3/2} = 2\cdot 3^{1/2}\pi(\sigma R/\rho)^{3/2}v_0^{-3} \quad (5)$$

where σ is the surface tension (0.5 N/m for tin), ρ is specific density ($7 \cdot 10^3$ kg/m$^3$ for liquid tin), R is the rotation radius and $v_0$ is the linear velocity of the rotating anode-cathode pair.

Note that a "large" centrifugal force is defined as a force having values between $10^2$ to $10^3$ N. The volume V depends strongly on the linear velocity $v_0$ and for typical values $v_0$=30 m/s at R=15 cm, the volume V of a droplet tin will be in the order of $10^{-5}$ cm$^3$ or 0.1 milligram.

Figure 5:
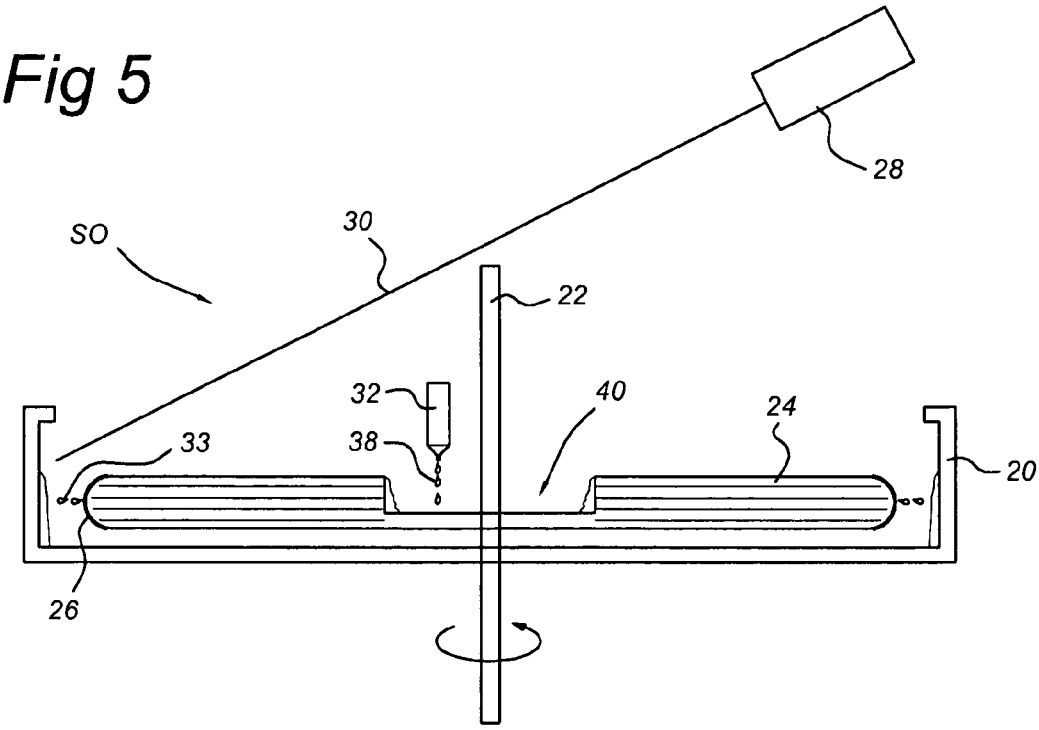
FIG. 5 shows a plasma radiation source SO according to a further embodiment of the invention.

FIG. 5 shows a further embodiment of the invention wherein the anode 24 comprises a lamellar anode body. The functioning of the plasma radiation source according to the embodiment shown in FIG. 5 is similar to the one of FIG. 4 except that the liquid metal progresses through channels of the lamellar body. When arriving at the anode rim 26, the liquid metal will be swept to the inner surface of the cathode or to the bath in the form of droplets.

Due to the relatively low velocity, see formulas (1) and (2), the droplets will hit the inner surface of the cathode 20, and/or the liquid metal bath 34 when present, at a relatively low velocity with respect to the cathode 20. Therefore, no rippling in the cathode bath 34 should be caused. Further, the anode surface is protected due to the formation of a thin liquid layer on the rim surface of the anode. This should result in a longer lifetime of the plasma radiation source SO.

Figure 6:
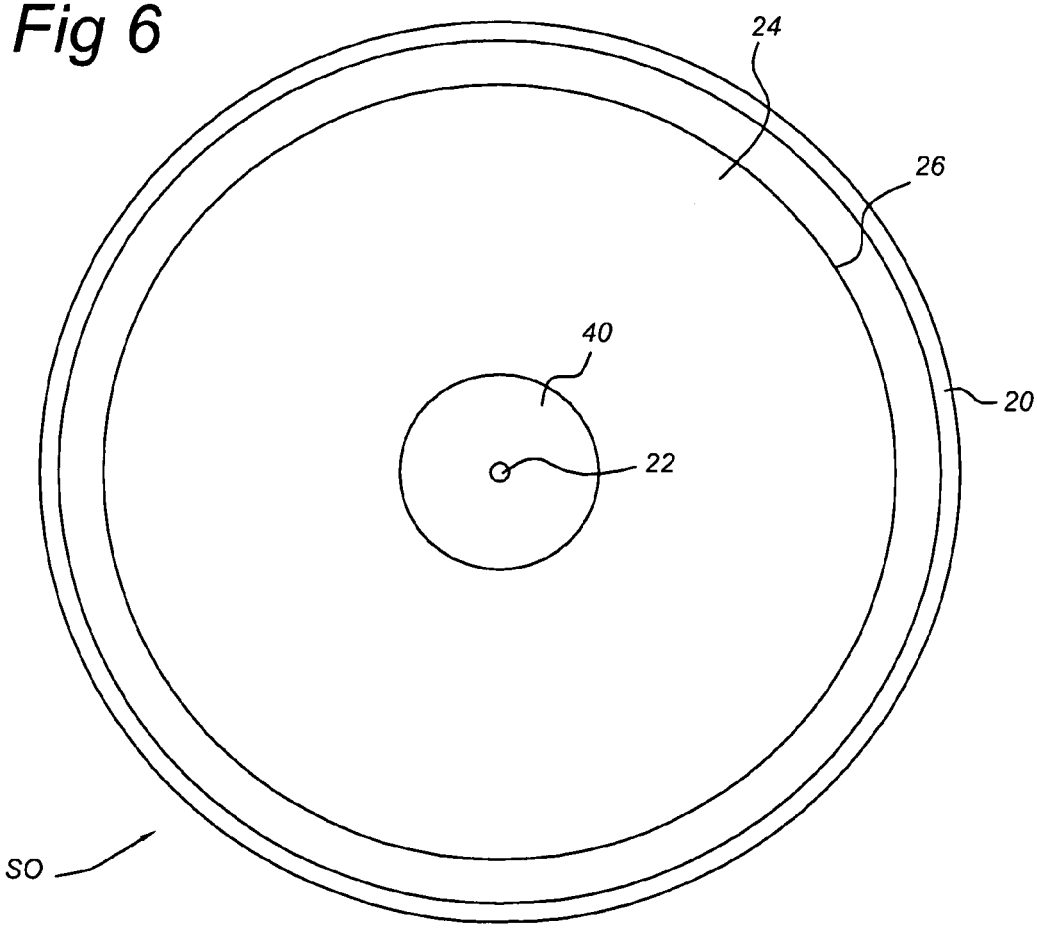
FIG. 6 shows a top view of the plasma radiation source of FIGS. 4 and 5.

FIG. 6 shows a top view of a plasma radiation source SO according to the embodiments of FIGS. 4 and 5. FIG. 6 shows the anode 24 inside the cathode 20. The rim 26 is shown from which droplets 33 are swept away. Furthermore, the hollow part 40 of the anode 24 around the rod 22 is visible.

As will be appreciated, any consumable working substance could be used. For example, instead of using Sn (tin), another metal may be used such as an alloy of tin and gallium, indium, an alloy of tin and indium or any other metal known for producing EUV radiation. Moreover, the invention is not restricted to EUV radiation only.

Although specific reference may be made in this text to the use of lithographic apparatus in the manufacture of ICs, it should be understood that the lithographic apparatus described herein may have other applications, such as the manufacture of integrated optical systems, guidance and detection patterns for magnetic domain memories, flat-panel displays, liquid-crystal displays (LCDs), thin-film magnetic heads, etc. The skilled artisan will appreciate that, in the context of such alternative applications, any use of the terms "wafer" or "die" herein may be considered as synonymous with the more general terms "substrate" or "target portion", respectively. The substrate referred to herein may be processed, before or after exposure, in for example a track (a tool that typically applies a layer of resist to a substrate and develops the exposed resist), a metrology tool and/or an inspection tool. Where applicable, the disclosure herein may be applied to such and other substrate processing tools. Further, the substrate may be processed more than once, for example in order to create a multi-layer IC, so that the term substrate used herein may also refer to a substrate that already contains multiple processed layers.

Although specific reference may have been made above to the use of embodiments of the invention in the context of optical lithography, it will be appreciated that the invention may be used in other applications, for example imprint lithography, and where the context allows, is not limited to optical lithography. In imprint lithography a topography in a patterning device defines the pattern created on a substrate. The topography of the patterning device may be pressed into a layer of resist supplied to the substrate whereupon the resist is cured by applying electromagnetic radiation, heat, pressure or a combination thereof. The patterning device is moved out of the resist leaving a pattern in it after the resist is cured.

The terms "radiation" and "beam" used herein encompass all types of electromagnetic radiation, including ultraviolet (UV) radiation (e.g. having a wavelength of or about 365, 355, 248, 193, 157 or 126 nm) and extreme ultra-violet (EUV) radiation (e.g. having a wavelength in the range of 5-20 nm), as well as particle beams, such as ion beams or electron beams.

The term "lens", where the context allows, may refer to any one or combination of various types of optical components, including refractive, reflective, magnetic, electromagnetic and electrostatic optical components.

While specific embodiments of the invention have been described above, it will be appreciated that the invention may be practiced otherwise than as described.

The descriptions above are intended to be illustrative, not limiting. Thus, it will be apparent to one skilled in the art that modifications may be made to the invention as described without departing from the scope of the claims set out below.

The invention claimed is:

1. A radiation source, comprising:

a cathode and an anode mounted inside the cathode, the anode and the cathode being configured and arranged to create a discharge in a substance in a discharge space between the anode and the cathode and to form a plasma so as to generate electromagnetic radiation, the anode and the cathode being rotatably mounted around a common axis of rotation, the cathode being arranged to hold a liquid metal;

an activation source arranged to direct an energy beam onto the liquid metal so as to vaporize part of the liquid metal in order to create a substance for the discharge; and a liquid metal provider arranged to supply additional liquid metal so as to compensate for the vaporized part of the liquid metal.

2. The radiation source of claim 1, wherein the liquid metal provider is arranged to supply the additional liquid metal to the anode and, in use of the radiation source, part of the additional liquid metal moves, due to centrifugal force, from a peripheral surface of the anode to an inner surface of the cathode.

3. The radiation source of claim 2, wherein the anode comprises a disc having an inclined rim and the liquid metal provider is arranged to supply the additional liquid metal onto the rim.

4. The radiation source of claim 2, wherein the anode comprises a hollow part at a top side of the anode, the liquid metal provider is arranged to supply the additional liquid metal into the hollow part, and the anode is arranged to transport the additional liquid metal from the hollow part through a body of the anode to a peripheral surface by way of centrifugal force.

5. The radiation source of claim 4, wherein the anode body is substantially porous.

6. The radiation source of claim 4, wherein the anode body is substantially lamellar.

7. The radiation source of claim 1, wherein the liquid metal provider is arranged to supply the additional liquid metal in the form of droplets.

8. A lithographic apparatus, comprising:

a radiation source, comprising:

a cathode and an anode mounted inside the cathode, the anode and the cathode being configured and arranged to create a discharge in a substance in a discharge space between the anode and the cathode and to form a plasma so as to generate electromagnetic radiation, the anode and the cathode being rotatably mounted around a common axis of rotation, the cathode being arranged to hold a liquid metal, an activation source arranged to direct an energy beam onto the liquid metal so as to vaporize part of the liquid metal in order to create a substance for the discharge, and a liquid metal provider arranged to supply additional liquid metal so as to compensate for the vaporized part of the liquid metal;

an illumination system configured to condition a radiation beam;

a support constructed to support a patterning device, the patterning device configured to impart the radiation beam with a pattern in its cross-section to form a patterned radiation beam;

a substrate table constructed to hold a substrate; and a projection system configured to project the patterned radiation beam onto a target portion of the substrate.

9. The lithographic apparatus of claim 8, wherein the liquid metal provider is arranged to supply the additional liquid metal to the anode and, in use of the radiation source, part of the additional liquid metal moves, due to centrifugal force, from a peripheral surface of the anode to an inner surface of the cathode.

10. The lithographic apparatus of claim 9, wherein the anode comprises a disc having an inclined rim and the liquid metal provider is arranged to supply the additional liquid metal onto the rim.

11. The lithographic apparatus of claim 9, wherein the anode comprises a hollow part at a top side of the anode, the liquid metal provider is arranged to supply the additional liquid metal into the hollow part, and the anode is arranged to transport the additional liquid metal from the hollow part through a body of the anode to a peripheral surface by way of centrifugal force.

12. The lithographic apparatus of claim 11, wherein the anode body is substantially porous.

13. The lithographic apparatus of claim 11, wherein the anode body is substantially lamellar.

14. The lithographic apparatus of claim 8, wherein the liquid metal provider is arranged to supply the additional liquid metal in the form of droplets.

15. A method of producing radiation comprising:

creating a discharge voltage across an anode and a cathode, the anode mounted inside the cathode and the cathode holding a liquid metal;

rotating the anode and the cathode around a common axis of rotation;

directing an energy beam onto the liquid metal so as to vaporize part of the liquid metal creating a discharge in the vapor in a discharge space between the anode and the cathode so as to form a plasma and generate electromagnetic radiation; and supplying additional liquid metal to the liquid metal so as to compensate for the vaporized part of the liquid metal.

16. The method of claim 15, comprising supplying the additional liquid metal to the anode and moving part of the additional liquid metal, due to centrifugal force, from a peripheral surface of the anode to an inner surface of the cathode.

17. The method of claim 16, wherein the anode comprises a disc having an inclined rim and comprising supplying the additional liquid metal onto the rim.

18. The method of claim 16, comprising supplying the additional liquid metal into a hollow part of the anode at a top side of the anode and transporting the additional liquid metal from the hollow part through a body of the anode to a peripheral surface of the anode by way of centrifugal force.

19. The method of claim 18, wherein the anode body is substantially porous.

20. The method of claim 18, wherein the anode body is substantially lamellar.

21. The method of claim 15, comprising supplying the additional liquid metal in the form of droplets.

* * * * *